United States Patent [19]

Kramer et al.

[11] Patent Number: 4,484,604

[45] Date of Patent: Nov. 27, 1984

[54] COMPOSITE DUAL-FACE HEDDLE FRAME SLAT

[75] Inventors: Charles F. Kramer, Greenville, S.C.; Richard A. Willard, Buffalo; Lawrence Kocher, Tonawanda, both of N.Y.

[73] Assignee: Steel Heddle Mfg. Co., Greenville, S.C.

[21] Appl. No.: 529,264

[22] Filed: Sep. 6, 1983

[51] Int. Cl.³ ..... D03D 9/00

[52] U.S. Cl. ..... 139/92

[58] Field of Search ..... 139/91, 92

[56] References Cited

U.S. PATENT DOCUMENTS

| | | | |
|---|---|---|---|
| 3,754,577 | 8/1973 | Heller | 139/92 |
| 4,036,263 | 7/1977 | Kaufmann | 139/91 |
| 4,112,980 | 9/1978 | Bader | 139/92 |
| 4,144,910 | 3/1979 | Bader | 139/91 |
| 4,249,579 | 2/1981 | Baumann et al. | 139/92 |

FOREIGN PATENT DOCUMENTS

| | | | |
|---|---|---|---|
| 2610311 | 9/1977 | Fed. Rep. of Germany | 139/92 |
| 2620778 | 10/1977 | Fed. Rep. of Germany | 139/92 |

*Primary Examiner*—Henry S. Jaudon

*Attorney, Agent, or Firm*—Dority & Manning

[57] ABSTRACT

A dual-face composite frame slat for a heddle frame of a loom includes a long-wall face (30) and a parallel short-wall face (32). Faces (30) and (32) are spaced from one another and define a core space (45) and upper and lower frame slat edges (36) and (38). Integral channel stiffeners (40) and (42) are interposed in the frame slat edges to provide integral beam structure. Faces (30) and (32) are constructed as a ten ply graphite reinforced plastic layup. Channel strips (40) and (42) have a four ply construction. A plastic heddle rod (22) is carried by a free flange portion (34) of the long-wall face and includes metal wear resistant caps (50).

15 Claims, 4 Drawing Figures

Fig. 3.
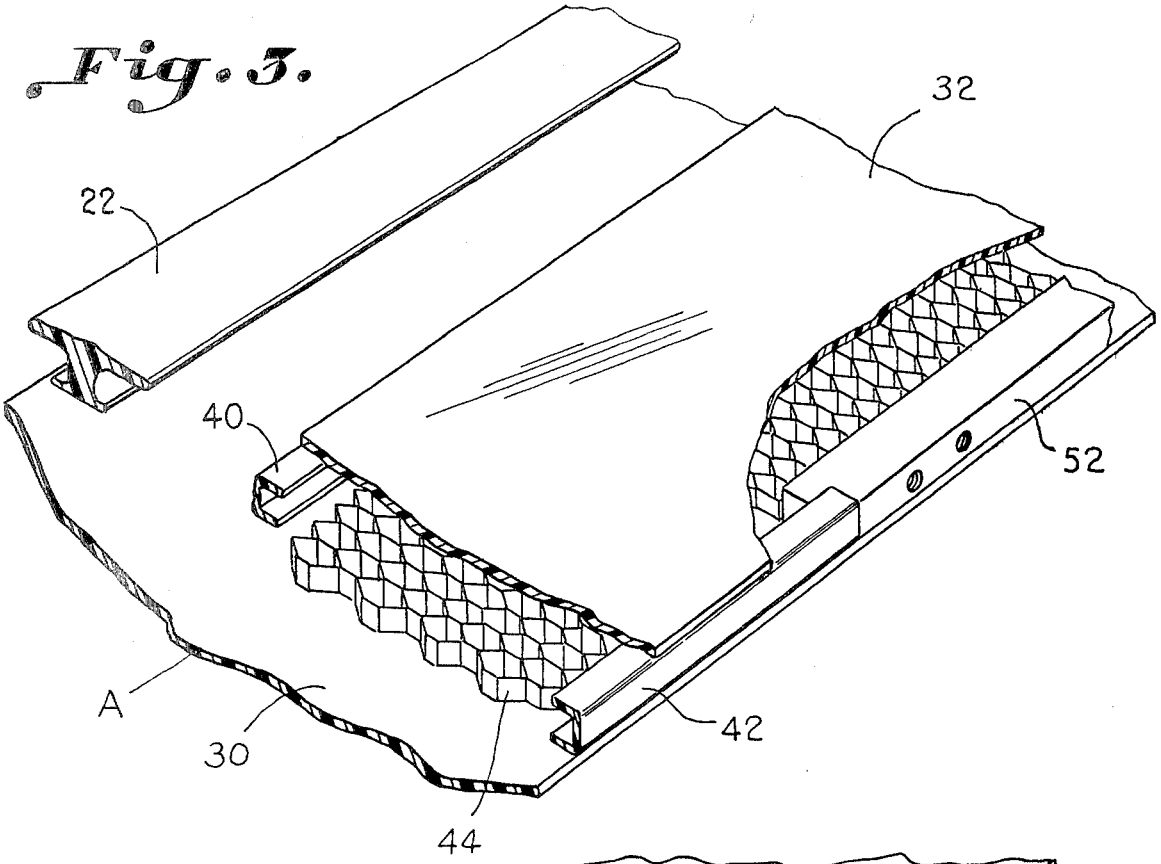
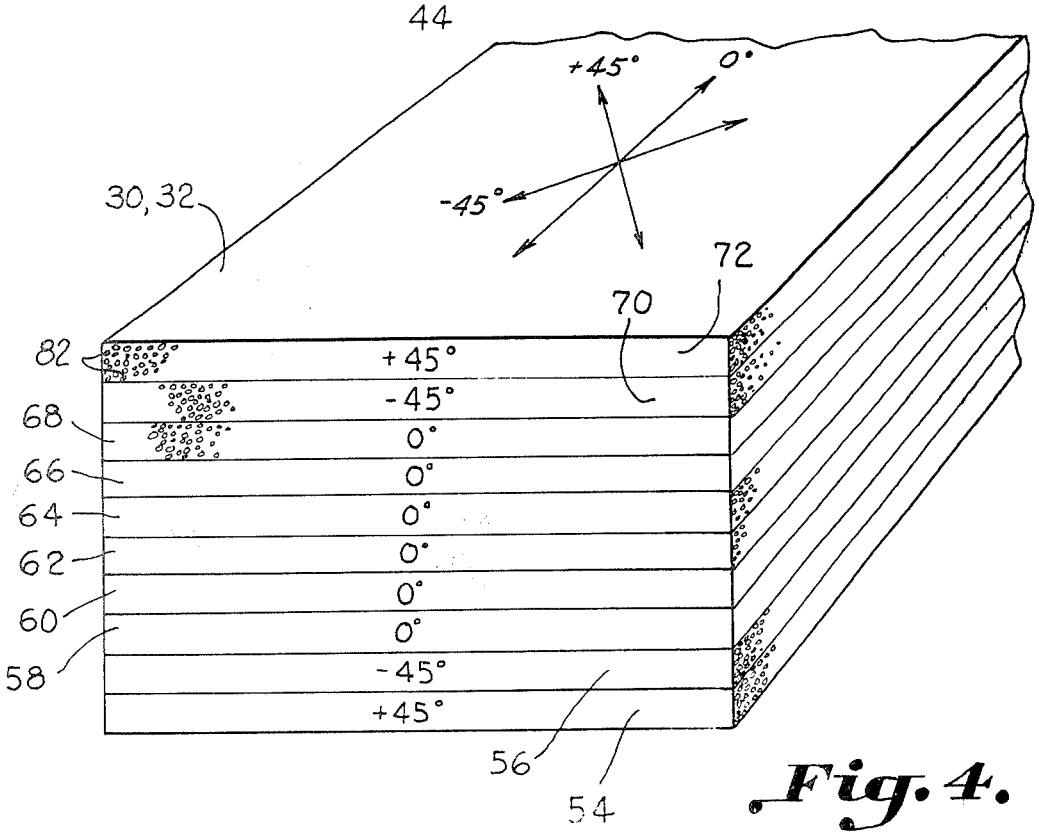
Fig. 4.

COMPOSITE DUAL-FACE HEDDLE FRAME SLAT

BACKGROUND OF THE INVENTION

The invention relates to a lightweight dual-face composite heddle frame slat for use on a loom. Typically, heddle frame slats are utilized in the construction of a heddle frame on a loom to support the heddle rods. The heddle frame includes a top frame slat and a bottom frame slat which are spaced apart in the frame by a pair of side frame members. The individual heddles are slidably carried on the heddle rods and supported in the frame having heddle eyes through which the warp yarns are threaded. The heddle frame raises and lowers the threads to create an open space called a shed through which the weft yarn is inserted during weaving.

In lifting the warp threads in the shedding motion during weaving, the heddle frame undergoes forces in two basic directions. First, the heddle frame encounters forces in the vertical direction while lifting the threads which produces a bending motion on the frame slat. Secondly, the heddle frame undergoes a front-to-back bending motion during beat-up of the fabric during which the reed beats the last pick of the weft yarn forward toward the fell of the fabric. These forces tend to bow the frame slats forwardly.

Typically, when heddle frames reach a length of one hundred inches or more, it has been necessary to add a center brace to the frame in order that it have sufficient stiffness to accommodate these forces.

Furthermore, with the advent of higher speed looms, the inertial loading on the heddle frames during shedding and beat-up motions is greatly increased. With the increased inertial forces acting on the heddle frame, there is an increased tendency of the heddle frame and hence frame slats to flex beyond the load imposed by warp threads and heddles. During the shedding and beat-up motions, once the heddle frame moves to the end of the stroke, there is a tendency for the free portions of the frame slat to continue moving because of inertia and the heavier it is the more that tendency is increased. The heavy weight of the longer heddle frames frequently render them unsuitable for the manual lifting in and out by the loom fixers. The increased weight makes the heddle frame difficult for the loom fixers to handle in the servicing and operation of the loom. The heavy weight of the frame is also detrimental to the life of the loom parts and the driving elements and linkages for the drive which drives the heddle frame.

Therefore, there is a need to provide a more lightweight heddle frame for high speed looms to lessen the inertial forces.

Typically, heddle frames having lengths of one hundred inches or more have required a center brace for stiffening the heddle frame and frame slats to accommodate the inertial and other loading forces during operation. With a center brace placed between the threads, a marking of the fabric being woven is often produced by the brace. The center brace is an additional expense and the installation and maintenance of the center brace is an additional and constant difficulty for the operator.

Heretofore, attempts have been made to provide more lightweight frames such as disclosed in U.S. Pat. Nos. 4,144,910 and 4,112,980. These devices have utilized the typical tubular construcion of the frame slat with reinforcing material added to the hollow portion of the frame slat. The heddle rod is attached to a depending flange which is secured in a conventional manner.

Netherlands Pat. No. 6,913,347 discloses a similar concept of a heddle frame slat wherein a tubular construction is provided filled with a reinforcing material such as foam plastic. Swiss Pat. No. 488,035, issued to Blatt, discloses a honeycomb reinforcement core for a frame slat.

All of the above prior frame slats while having some increased stiffness are of the typical tubular construction and are not entirely satisfactory. The heddle supporting rod is affixed as a separate depending member to the frame slat rendering it vulnerable to loosening and fatigue.

SUMMARY OF THE INVENTION

Accordingly, an important object of the present invention is to provide a frame slat for a heddle frame assembly which is lighter than a comparably sized metal frame slat yet has a higher stiffness.

Yet another important object of the present invention is to provide a frame slat construction for a heddle frame assembly which is lightweight yet can be used on wide looms of one hundred inches or more without the need of a center brace.

Yet another important object of the present invention is to provide a frame slat for a heddle frame having increased stiffnes and resistance to deflection under load yet has decreased inertial loading for use on high speed looms.

Yet another important object of the present invention is to provide a lightweight frame slat for a heddle frame assembly which has a reinforced construction at the points of extreme fiber stress and the maximum points of bending of the frame.

Still another important object of the present invention is to provide a lightweight frame slat constructed of dissimilar materials to decouple and absorb the propagation of noise caused by the impact of the heddles against the heddle rod attached thereto during weaving.

The above objectives are accomplished according to the present invention by providing a lightweight frame slat for a heddle frame assembly of a loom yet having increased stiffness which comprises an elongated long-wall face plate extending generally the entire length of the heddle frame assembly. An elongated short-wall face plate extends generally the length of the heddle frame assembly parallel to the long-wall face plate. The short-wall face plate is spaced from the long-wall face plate and is parallel to the long-wall face to define a core space therebetween. An upper and a lower frame edge are defined between the long-wall face and the short-wall face plates. An integral stiffening element is interposed between the long-wall and short-wall face plates along the upper and lower frame slat edges joining same together as an integral beam structure. The stiffening elements stiffen the short and long-wall face plates against bending in a vertical and horizontal direction transverse to the elongated dimension of the frame slat reinforcing the frame slat at the points of extreme fiber stress and maximum bending of the rectangle described by these elements. The long-wall face plate extends past the short-wall face plate in a direction transverse to the elongated dimension to define a free flange portion. A heddle rod is integrally carried by the free flange portion of the long face of the frame slat.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 3 is a perspective view with parts cut away of a lightweight dual face composite frame slat constructed according to the present invention; and FIG. 4 is a schematic illustration of a lay-up of a fiber reinforced face plate for a composite frame slat constructed according to the present invention.

DESCRIPTION OF A PREFERRED EMBODIMENT

Figure 1:
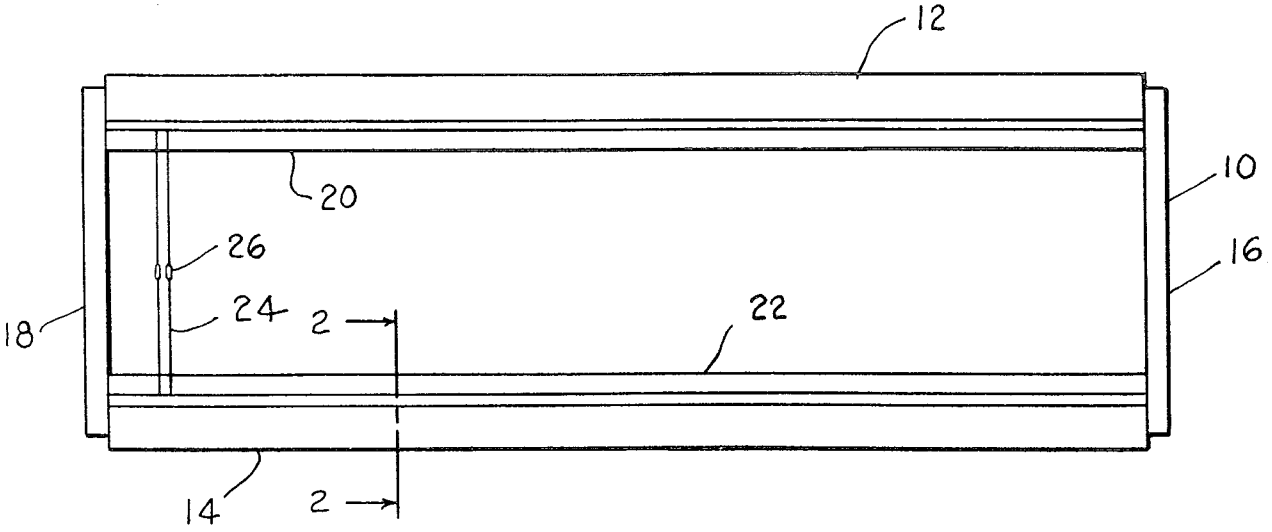
FIG. 1 is a front elevation of a heddle frame for a loom incorporating frame slats constructed according to the present invention.
Figure 2:
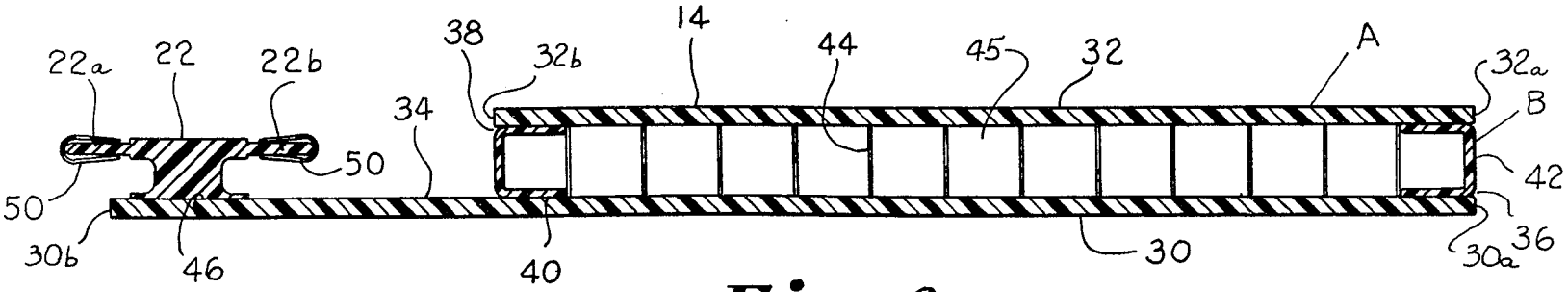
FIG. 2 is a sectional view taken along line 2—2 of FIG. 1 illustrating a lightweight frame slat constructed according to the present invention.

The invention relates to a moving heddle frame on a loom which holds the warp threads and raises and lowers the warp threads in a shedding motion during weaving. Since the structural and operational aspects of a loom are well known, only so much of a loom as is necessary to an understanding of the invention is disclosed herein.

Accordingly, since the use of heddle frames on looms are well known, only the construction of the frame slat is illustrated in detail in the drawings and disclosed herein as including a unique frame slat construction which is more lightweight and may be used on wider looms without the need of a center brace.

A heddle frame 10 is illustrated which includes a pair of frame slats A constructed according to the present invention. A top frame slat 12 is carried by the frame and a bottom slat 14 is carried by the frame. A pair of side frame members 16 and 18 space the frame slats apart from one another. Frame slat 12 includes an integral heddle supporting rod 20. There is a corresponding heddle support rod 22 carried on the bottom frame slat 14.

A plurality of heddles 24 are carried by the heddle rods 20 and 22 which include end slots received over the rods in a conventional manner. The heddles include a heddle eye 26 through which the individual warp yarn thread ends are threaded and guided during weaving. The warp yarns are guided through the heddle frame during weaving and are lifted and lowered as the heddle frame is driven up and down in a shedding motion. The heddles 24 normally include an end slot which is in the form of a C-shaped slot for use with the type heddle rod illustrated herein.

Referring now in more detail to the frame slat construction, the frame slat is illustrated as including a long-wall face plate 30 and a short wall face plate 32. The plates 30 and 32 are spaced from one another and define back and front faces of the frame slat, respectively. The face plates are elongated in the width or length dimension of the heddle frame as viewed from left to right in FIG. 1. The long-wall and short-wall face plates extend generally the entire length of the heddle frame assembly. Long-wall face plate 30 includes a top edge 30*a* and a bottom edge 30*b*. Short-wall face plate 32 includes a top edge 32*a* generally flush with top edge 30*a* and a terminal edge 32*b* terminating short of the bottom edge 30*b*.

The long wall face plate 30 extends past the terminal edge 32*b* of the short-wall face plate to define a free flange portion 34. An upper frame slat edge 36 is defined between the top edge 30*a*, 32*a* of the long-wall and the short-wall face plates 30, 32. A lower frame slat edge 38 is likewise defined between terminal edge 32*b* of the short-wall face plate and the long-wall face plate.

Means is provided for stiffening the upper and lower frame slat edges where the extreme fiber stress occurs under bending forces in the form of an integral stiffening means B. The stiffening means B provides a stiffened beam structure together with the face plates 30, 32. The integral stiffening means includes a U-shaped channel element 40 which extends the length of the face plates 30 and 32. The U-shaped stiffening element 40 is carried along the lower edge 38. A correspondingly shaped element 42 is carried along the upper edge 36. The elements are located at the extreme fiber stress of a rectangle defined by these elements, the short-wall face plate, and the co-extending portion of the long-wall face plate.

There is a core of filling material 44 carried in the core space 45 defined between the long wall face plate 30 and the short-wall face plate 32. The core material may be any suitable material. Nomex nylon honeycomb is preferred while other suitable lightweight materials may also be utilized, preferably in a honeycomb configuration.

The heddle rod 22 is preferably a plastic pultrusion which is unitarily attached to the flange element 34 by any suitable epoxy adhesive. The plastic heddle rod includes opposing edges 22*a* and 22*b* which are reduced in thickness compared to the main body of the heddle rod and include metallic capping means in the form of a metal cap 50 which protects the plastic material against wear from the metal heddle. The heddle rod may be constructed and dimensioned in accordance with the teachings of application of Ser. No. 393,635, filed June 30, 1982, entitled EXTRUDED HEDDLE ROD AND CAP, commonly assigned to the assignee herein.

The integral stiffening elements 40 and 42 may also be made integral with the long and short-wall face plates by any suitable means such as by gluing with epoxy adhesive.

Provision may be made for an insertion block 52 which is threaded for attachment to various accessories such as the drive mechanism for reciprocating the heddle frame up and down in the shedding motion. The block is preferably aluminum and may be attached by any suitable means, such as epoxy adhesive, between plates 30, 32 with a gap provided in stiffening channel 42.

Referring now to FIG. 4, a composite lay-up for the long-wall face plate 30 and short-wall face plate 32 is illustrated wherein each plate includes ten layers or plys of reinforcement, such as graphite fibers 82, imbedded in a suitable resin matrix. As illustrated, in the two outer layers 70 and 72 the graphite fibers are illustrated as being oriented along axes at forty-five degrees relative to each other. The same is true of outer layers 54 and 56. The remaining intermediate layers 58, 60, 62, 64, 66, and 68, include fibers which are oriented along a zero degree axis as being parallel with the edges of the plates. While other fiber orientations may be utilized, the above has been found to be particularly advantageous in the construction of a frame slat. It is to be understood, of course, that other fibers may be utilized separately or in combination in the matrix to reinforce the plate such as Kevlar, Boron, or glass fibers.

The stiffening elements 40 and 42 are preferably constructed from a four-ply or layer lay-up which includes a resin matrix in which reinforcing fibers, such as graphite, are imbedded. The stiffening elements impart stiffness to the frame slat as a beam structure against forces acting on the frame slat in the vertical and horizontal direction during the shedding motion. The extreme fiber stress at the maximum points of bending along the edges 36 and 38 are suitably reinforced for large frame slat lengths up to one hundred and fifty inches without the need of a center brace. The frame slat is lightweight and the core reinforcement affords adequate stiffness in the forward and rearward directions against deflection and bending during the beat-up motion on the loom.

The frame slat thus provided is highly advantageous for high speed looms since it is lightweight and has low inertial forces and yet is stiff enough to be used on wide looms without a center brace. The disimilar materials used in the construction facilitate dampening of the noise imparted during operation of the loom.

While a preferred embodiment of the invention has been described using specific terms, such description is for illustrative purposes only, and it is to be understood that changes and variations may be made without departing from the spirit or scope of the following claims.

What is claimed is:

1. In a heddle frame assembly for a loom of the type which includes upper and lower frame slats vertically spaced by side frame members, heddle rods carried by said frame slats between which heddles are supported in the frame, and a drive connector means by which said heddle frame is operatively connected to a drive means for reciprocating the heddle frame up and down in a shedding motion, wherein said heddle frame slat comprises:

an elongated long-wall face plate extending generally the entire length of said heddle frame assembly having a top edge and a bottom edge;

an elongated short-wall face plate extending generally the length of said heddle frame assembly parallel to said long-wall face plate, said short-wall face having a top edge and a terminal edge, said terminal edge terminating short of said bottom edge of said long-wall face plate;

said short-wall face plate being spaced from said long-wall face plate and parallel thereto to define a core space therebetween;

an upper frame slat edge defined between said top edges of said long-wall and short-wall face plates and a lower frame slat edge defined between said long-wall face plate and said terminal edge of said short-wall face plate;

integral stiffening means interposed between said long-wall face plate and short-wall face plate along said upper and lower frame slat edges joining same together as an integral beam structure and stiffening said frame slat against bending and reinforcing said frame slat at the extreme fiber stress;

said long-wall face plate extending past said terminal edge of said short-wall face plate to define a free flange portion; and a heddle rod carried by said free flange portion of said long-face of said frame slat spaced below said terminal edge of said short-wall face plate.

2. The frame slat of claim 1 including a reinforcement core of lightweight material disposed in said core space between said long-wall face and short-wall face.

3. The frame slat of claim 1 wherein said long-wall face and said short-wall face include a layup construction of a plurality of layers of fiber reinforced plastic.

4. The frame slat of claim 3 wherein said layers of fiber reinforced plastic composite include layers in which the reinforcing fibers are oriented at a angle with respect to each other in adjacent layers so as to afford maximum structural integrity and reinforcement against bending.

5. The frame slat of claim 4 wherein said layup construction includes a first plurality of outer layers wherein said fibers are oriented at a predetermined angle with respect to each other, a plurality of intermediate layers adjacent said first plurality of layers wherein said fibers are aligned with one another in direction, and a second plurality of outer layers adjacent said intermediate layers wherein said fibers are oriented at said predetermined angle relative to one another.

6. The frame slat of claim 5 wherein said predetermined angle is forty-five degrees.

7. The frame slat of claim 1 wherein said integral stiffening means includes a generally U-shaped channel strip.

8. In a heddle frame assembly for a loom of the type which includes upper and lower frame slats vertically spaced by side frame members, heddle rods carried by said frame slats between which heddles having end slots received over the heddle rods are supported in the frame, and a drive connector means by which said heddle frame is operatively connected to said heddle drive for reciprocating the heddle frame up and down in a shedding motion, wherein said heddle frame slat comprises:

an elongated long-wall face plate constructed from fiber reinforcing plastic extending generally the entire length of said heddle frame assembly having a top edge and a bottom edge;

an elongated short-wall face plate constructed from fiber reinforced plastic extending generally the length of said heddle frame assembly parralel to said long-wall face plate, said short-wall face having a top edge and a terminal edge terminating short of said bottom edge of long-wall face plate;

said short-wall face plate being spaced from said long-wall face plate and parallel thereto to define a core space therebetween;

an upper frame slat edge defined between said top edges of said long-wall and short-wall face plates and a lower frame slat edge defined between said long-wall face plate and said terminal edge of said short-wall face plate;

integral stiffening means interposed between said long-wall face plate and short-wall face plate along said upper and lower frame slat edges joining same together as an integral beam structure stiffening said frame slat against bending and reinforcing said frame slat at critical assembly points of fiber stress;

a core of lightweight reinforcing material disposed in said core space between said short-face and long-face;

said long-wall face plate extending past said terminal edge of said short-wall face plate to define a free flange portion;

a heddle rod carried by said free flange portion of said long-face of said frame slat below said terminal edge of said short-wall face plate;

said heddle rod being constructed from a lightweight plastic material having free edges over which said heddle end slots slide and are retained; and metallic cap means covering said free edges of said heddle rod reducing wear of said plastic material by said heddles.

9. The frame slat of claim 8 wherein said core includes a honeycomb structure.

10. The frame slat of claim 8 wherein said integral stiffening means includes a generally U-shaped channel strip.

11. In a heddle frame assembly for a loom of the type which includes upper and lower frame slats vertically spaced by side frame members, heddle rods carried by said frame slats between which heddles are supported in the frame, and a drive connector means by which said heddle frame is operatively connected to a drive means for reciprocating the heddle frame up and down in a shedding motion, wherein said heddle frame slat comprises:

an elongated long-wall face plate constructed from fiber reinforced plastic composite extending generally the entire length of said heddle frome assembly having a top edge and a bottom edge;

an elongated short-wall face plate constructed from fiber reinforced plastic composite extending generally the length of said heddle frame assembly parallel to said long-wall face plate, said short-wall face having a top edge and a terminal edge terminating short of said bottom edge of said long-wall face plate;

said short-wall face plate being spaced from said long-wall face plate and parallel thereto to define a core space therebetween;

an upper frame slat edge defined between said top edges of said long-wall and short-wall face plates and a lower frame slat edge defined between said long-wall face plate and said terminal edge of said short-wall face plate;

means interposed between said long-wall face plate and short-wall face plate along said upper and lower frame slat edges providing reinforcing beam structure;

said long-wall face plate extending past said terminal edge of said short-wall face plate to define a free flange portion;

a heddle rod carried by said free flange portion of said long-face of said frame slat below said terminal edge of said short-wall face plate;

said long-wall face and said short-wall face including a layup construction of a plurality of layers of fiber reinforced plastic; and said layup construction including a first plurality of outer layers wherein said fibers are oriented at a predetermined angle with respect to each other, a plurality of intermediate layers adjacent said first plurality of layers wherein said fibers are aligned with one another in direction, and a second plurality of outer layers adjacent said intermediate layers wherein said fibers are oriented at said predetermined angle relative to one another.

12. The frame slat of claim 11 comprising a lightweight core material filling said core space between said long-wall face and short-wall face.

13. The frame slat of claim 12 wherein said core includes a honeycomb structure of Nomex type nylon.

14. The frame slat of claim 11 wherein said predetermined angle is forty-five degrees.

15. The frame slat of claim 11 including an integral stiffening means disposed between said upper and lower frame slat edges which includes a U-shaped member having a multi-ply fiber reinforced construction.

* * * * *